US008860321B2

(12) United States Patent
Ide et al.

(10) Patent No.: US 8,860,321 B2
(45) Date of Patent: Oct. 14, 2014

(54) LED CONTROL DEVICE AND LIQUID CRYSTAL DISPLAY APPARATUS

(75) Inventors: Masahiro Ide, Osaka (JP); Motoyuki Oniki, Osaka (JP); Tomoyuki Ichiza, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 13/698,058

(22) PCT Filed: Jun. 28, 2011

(86) PCT No.: PCT/JP2011/064764

§ 371 (c)(1),
(2), (4) Date: Nov. 15, 2012

(87) PCT Pub. No.: WO2012/002366

PCT Pub. Date: Jan. 5, 2012

(65) Prior Publication Data

US 2013/0057165 A1 Mar. 7, 2013

(30) Foreign Application Priority Data

Jul. 1, 2010 (JP) ..... 2010-151163

(51) Int. Cl.

| | |
|---|---|
| ***H05B 37/00*** | (2006.01) |
| ***G09G 3/34*** | (2006.01) |
| ***G09G 3/20*** | (2006.01) |
| ***H05B 33/08*** | (2006.01) |

(52) U.S. Cl.

CPC ..... *H05B 33/0845* (2013.01); *G09G 3/3406* (2013.01); *G09G 3/2092* (2013.01)

USPC ..... 315/186; 315/246; 315/294; 345/87

(58) Field of Classification Search

USPC ..... 315/121, 122, 185 R, 193, 224, 246, 315/291, 294, 297, 307, 308, 312, 320; 345/82–84, 87, 94; 362/123, 277, 800, 362/806

See application file for complete search history.

(56) References Cited

U.S. PATENT DOCUMENTS

| | | | | |
|---|---|---|---|---|
| 2005/0007085 | A1 * | 1/2005 | Murakami | 323/282 |
| 2008/0203936 | A1 * | 8/2008 | Mariyama et al. | 315/246 |
| 2009/0079362 | A1 * | 3/2009 | Shteynberg et al. | 315/294 |

FOREIGN PATENT DOCUMENTS

| | | | |
|---|---|---|---|
| JP | 2005-33853 | A | 2/2005 |
| JP | 2009-32497 | A | 2/2009 |
| JP | 2009-188135 | A | 8/2009 |

*Primary Examiner* — Thienvu Tran
*Assistant Examiner* — Christopher Lo
(74) *Attorney, Agent, or Firm* — Birch, Stewart, Kolasch & Birch, LLP

(57) ABSTRACT

Provided are an LED control device and a liquid crystal display apparatus, wherein energy loss or noise (humming sound) to be generated upon switching the control of power supplying from a power supply device to a plurality of LED groups, between constant current control and constant voltage control, can be alleviated. In a configuration wherein power to be supplied from one power supply device, to which a plurality of LED groups are connected in parallel, is controlled with constant current control wherein the voltage at the end section at the cathode side of the LED group to be turned on is to be maintained at a predetermined first voltage value, when at least one of the LED groups is to be turned on, and controlled with constant voltage control wherein the voltage at the end sections at the anode side of the LED groups is to be maintained at a predetermined second voltage value, when all the LED groups are to be turned off, a phase difference of $2\pi/n$ (n is the number of LED groups) is made to be generated between PWM signals corresponding to each of the LED groups.

3 Claims, 7 Drawing Sheets

LED CONTROL DEVICE AND LIQUID CRYSTAL DISPLAY APPARATUS

TECHNICAL FIELD

The present invention relates to an LED control device that controls LEDs disposed on a backlight device used to illuminate a liquid crystal display panel and a liquid crystal display apparatus having the LED control device, and, more particularly, to a technique intended to suppress energy loss and noise attendant on the drive of the backlight device.

BACKGROUND OF THE INVENTION

A liquid crystal display apparatus such as a liquid crystal television receiver or a liquid crystal monitor is generally mounted with a backlight device that illuminates a liquid crystal display panel by a plurality of LEDs. In the backlight device, PWM control is performed that controls the duty ratio indicating the ratio of on period of an LED in a one-cycle control period to regulate the luminance of the LED.

Although in recent years a multiplicity of LEDs are disposed on the backlight device due to, e.g., the increased size of the liquid crystal display panel, the number of the LEDs is limited that can be connected in series at an output voltage of a power supply circuit supplying electric power to the backlight device. For this reason, a configuration is employed such that the plurality of LEDs are divided into a plurality of LED groups and connected in series and that the LED groups are connected in parallel to the power supply circuit (see, e.g., Patent Documents 1 and 2).

Patent Document 1 proposes to control the output voltage of the power supply device so that voltages at connection points between the LED groups and a constant-current output circuit are constant, to thereby supply a constant current required for the drive of the LED groups. Hereinafter, such a control is referred to as constant-current control.

In the configuration according to Patent Document 1, however, the output voltage becomes low when all the LED groups go out, so that when an LED group subsequently go on, it may be difficult to instantly supply a current required for the drive of the LED group.

It is thus conceivable to execute the constant-current control only when any one of the plurality of LED groups is on but to execute a constant-voltage control for controlling the output voltage so that the voltages applied to the LED groups become a predetermined value when all the LED groups are off. As a result of this, when an LED group starts to be turned on, the LED group can stably go on, while a required current can be supplied during the turning on of the LED group. The predetermined voltage value is set to a slightly higher level so that a sufficient current can be supplied at the start of turn-on of the LED group.

PRIOR ART DOCUMENT

Patent Documents

Patent Document 1: Japanese Laid-Open Patent Publication No. 2005-33853

Patent Document 2:Japanese Laid-Open Patent Publication No. 2009-188135

SUMMARY OF THE INVENTION

Problem to be Solved by the Invention

In the configuration switching the constant-current control and the constant-voltage control, however, there is a problem that energy loss may occur upon the switching when PWM signals used for the control of the plurality of LED groups are in phase.

Specifically, FIGS. 6 and 7 are timing charts in the case of controlling, by in-phase PWM signals, the drive of each of two LED groups 171 and 172 each consisting of a plurality of LEDs connected in series. FIG. 6(*a*) depicts a case where the PWM signals have a duty ratio of 50% or more and FIG. 7(*b*) depicts a case where the PWM signals have a duty ratio of less than 50%.

As depicted in FIGS. 6(*a*) and 7(*b*), when phases of the PWM signals corresponding respectively to the LED groups 171 and 172 are in phase, the LED groups 171 and 172 go on and off at the same time. Hence, switching occurs between the constant-current control and the constant-voltage control in one cycle of the PWM control. Then, when the control is switched from the constant-voltage control to the constant-current control, inefficient energy loss (hatched portions of FIGS. 6 and 7) occurs instantaneously at the start of turning on of the LED groups 171 and 172 since the anode voltage applied to the LED groups 171 and 172 is set to a slightly higher value. The energy loss is obtained by multiplying the cathode voltage of the LED groups 171 and 172 by a current flowing through the LED groups 171 and 172. In case the output current from the power supply device sharply varies upon switching between the constant-voltage control and the constant-current control, the variation may cause a noise (humming sound) in electronic components such as coils or capacitors of the power supply device.

Although Patent Document 2 proposes to suppress a variation of the power-supply voltage by producing a phase difference to PWM signals corresponding to a plurality of LED groups, it does not assume the configuration switching between the constant-current control and the constant-voltage control and does not describe nor suggest the suppression of the energy loss and noise occurring upon the switching.

The present invention was thus conceived in view of the above circumstances and an object thereof is to provide an LED control device and a liquid crystal display apparatus capable of suppressing energy loss and noise (humming sound) when switching the control of power supplied from a power-supply device to a plurality of LED groups between constant-current control and constant-voltage control.

Means for Solving the Problem

To achieve the above object, the present invention is applied to an LED control device turning on and off a plurality of LEDs for each of LED groups connected to a plurality of constant-current output circuits and is characterized by having constituent elements (1) to (3) which follow.

(1) An LED driving means that individually controls whether to supply currents to the LED groups by the constant-current output circuits, in accordance with PWM signals input corresponding respectively to the LED groups.

(2) A power-supply control means that, when at least one of the LED groups is turned on, controls a power supplied from a power-supply device to which the LED groups are connected in parallel by a first voltage control mode in which a voltage at a cathode end of the lighting LED group is kept at a predetermined first voltage value, the power-supply control means, when all the LED groups are turned off, controls the power by a second voltage control mode in which a voltage at an anode end of the LED group is kept at a predetermined second voltage value.

(3) A phase difference control means that produces a phase difference of $2\pi/n$ (n: the number of LED groups) to the PWM signals corresponding respectively to the LED groups input to the LED driving means.

According to the present invention, the energy loss attributable to switching between the first voltage control mode and the second voltage control mode can be prevented since occurrence of the phase difference of $2\pi/n$ to the PWM signals corresponding respectively to the LED groups allows turning-on of at least one of the LED groups and therefore the execution of the first voltage control mode at all times if the duty ratio of the PWM signal is 100/n % or more. The noise (humming sound) is also prevented that occurs as a result of a sharp current variation in the power-supply device at the time of switching between the first voltage control mode and the second voltage control mode.

Although the switching is performed between the first voltage control mode and the second voltage control mode if the duty ratio of the PWM signal is less than 100/n %, the second voltage control mode execution period becomes shorter as compared with the case where the PWM signals corresponding respectively to the LED groups voltage are in phase. This reduces the voltage applied to the LED groups upon the switching from the second voltage control mode to the first voltage control mode, as compared with the case where the PWM signals corresponding respectively to the LED groups voltage are in phase, thereby achieving a suppression of the energy loss upon the switching. The reason is that voltage applied from the power-supply device to the LED groups gradually increases toward the second voltage value after the switching from the first voltage control mode to the second voltage control mode and hence that at earlier stages the voltage applied to the LED groups does not yet reach the second voltage value and is low.

The plurality of LEDs are disposed on the backlight device that illuminates a liquid crystal display panel. The invention of this application may be understood as the invention relating to a liquid crystal display apparatus having the LED control device.

Effect of the Invention

According to the present invention, the energy loss and noise (humming sound) can be suppressed when switching the control of power supplied from the power-supply device to the plurality of LED groups between the constant-current control and the constant-voltage control.

PREFERRED EMBODIMENT OF THE INVENTION

Referring to the accompanying drawings, an embodiment of the present invention will now be described for the understanding of the present invention. The following embodiment is a mere example embodying the present invention and is not intended to limit the technical scope of the present invention.

Figure 1:
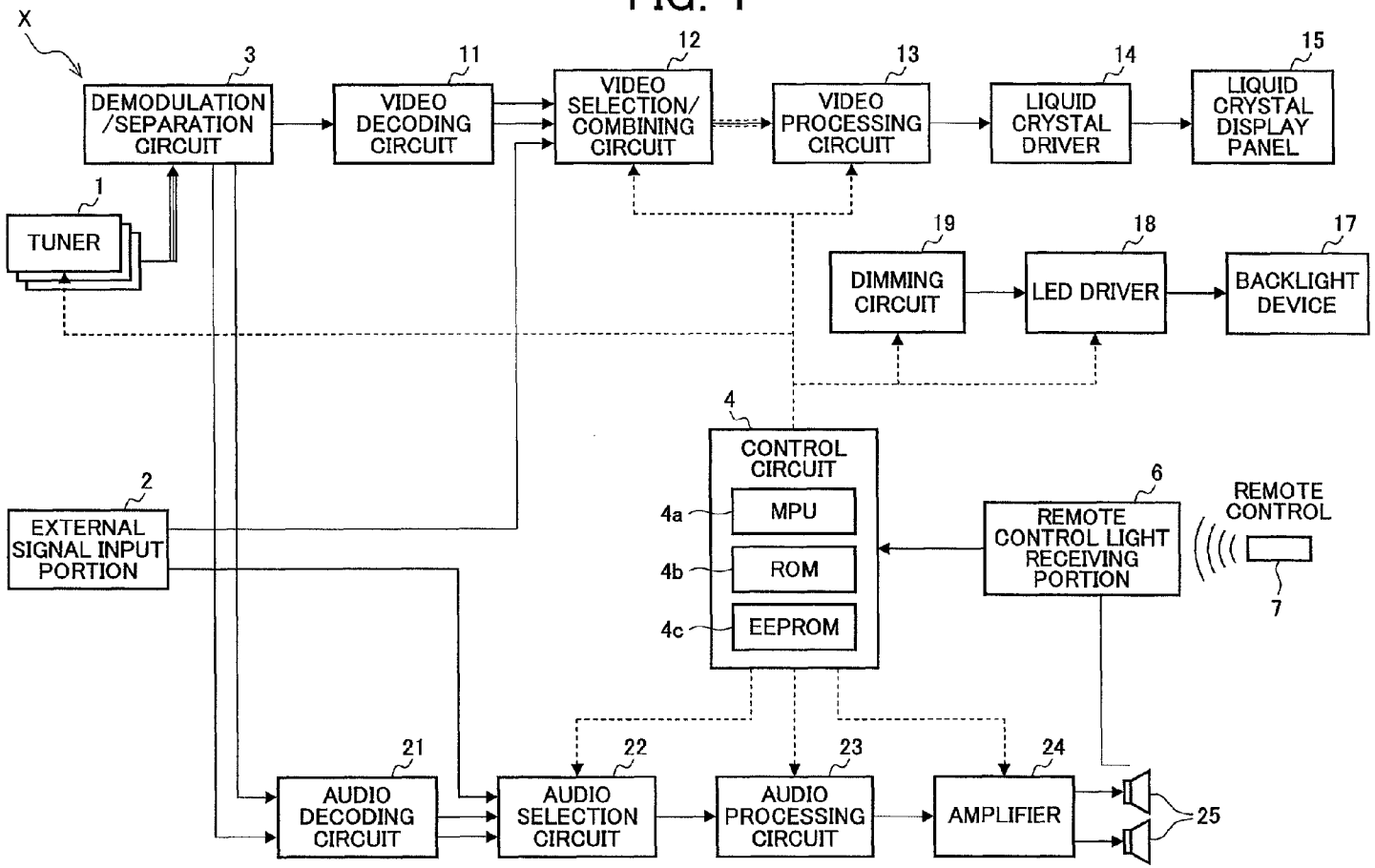
FIG. 1 is a block diagram depicting a schematic configuration of a liquid crystal television receiver X according to an embodiment of the present invention.

As depicted in FIG. 1, a liquid crystal television receiver X (one example of a liquid crystal display apparatus) according to the embodiment of the present invention includes a plurality of tuners 1, an external signal input portion 2, a demodulation/separation circuit 3, a video decoding circuit 11, a video selection/combining circuit 12, a video processing circuit 13, a liquid crystal driver 14, a liquid crystal display panel 15, a backlight device 17, an LED driver 18, a dimming circuit 19, an audio decoding circuit 21, an audio selection circuit 22, an audio processing circuit 23, an amplifier 24, a speaker 25, a control circuit 4, a remote control light receiving portion 6, and a remote control (remote operation unit) 7. In this embodiment, the LED driver 18 and the dimming circuit 19 correspond to an LED control device. Not only the liquid crystal television receiver but also the liquid crystal monitor, etc., correspond to the liquid crystal display apparatus according to the present invention.

The remote control light receiving portion 6 is a signal transmission interface that performs a radio signal reception/transmission by infrared rays, from the remote control 7 for operating the liquid crystal television receiver X, in accordance with a predetermined signal transmission protocol (so-called remote control protocol). The remote control light receiving portion 6 then extracts from an infrared signal a signal indicative of operation input information for the remote control 7 and transmits the signal to the control circuit 4.

The control circuit 4 includes an MPU 4*a* acting as a computing means and a ROM 4*b* (EPROM) and an EEPROM 4*c* that are storage means, the MPU 4*a* executing a control program to control the entire liquid crystal television receiver X. The ROM 4*b* stores in advance the control program executed by the MPU 4*a*. The EEPROM 4*c* stores various data that are read/written (referred to or written into) in processes executed by the MPU 4*a*.

The tuner 1 is an electronic part that extracts a signal of a content (broadcast program) on the air from a television broadcast signal input. More specifically, the tuner 1 extracts a signal having a carrier frequency component containing a signal of a broadcast program instructed to select by the control circuit 4 and transmits the extracted signsl to the demodulation/seperation circuit 3 which follows. The tuner 1 is individually disposed for each of broadcast media (terrestrial signal, BS, CS, ect.).

The demodulation/separation circuit 3 demodulates a transport stream signal (hereinafter, TS signal) from the carrier frequency component transmitted from the tuner 1. The demodulation/separation circuit 3 then separates and extracts, from the demodulated TS signal, a video signal and an audio signal corresponding to a broadcast program to be viewed and meta-data (content information). The demodulation/separation circuit 3 then extracts a video signal and an audio signal of a broadcast program to be viewed in accordance with a PID (Packet IDentification) received from the control circuit 4 and transmits respective signals to the video decoding circuit 11 and the audio decoding circuit 21, respectively.

The audio decoding circuit 21 decodes an audio signal transmitted from the demodulation/separation circuit 3 and transmits the decoded audio signal to the audio selection circuit 22.

The audio selection circuit 22 is a circuit that, in accordance with a control command from the control circuit 4, selects one audio signal from between an audio signal of the content of a broadcast program tuned by the tuner 1 (an audio signal input through the audio decoding circuit 21) and an audio signal input through the external signal input portion 2 and transmits it to the audio processing circuit 23.

The audio processing circuit 23 performs, in accordance with an instruction from the control circuit 4, various signal processes for the audio signal selected by the audio selection circuit 22. For example, the audio processing circuit 23 performs an equalization process, a surround process, etc., conforming to the characteristics of the speaker.

The amplifier 24 performs a process for amplifying or attenuating the audio signal processed by the audio processing circuit 23 in accordance with an instruction from the control circuit 4, to output the resultant signal to the speaker 25.

The external signal input portion 2 is a signal input interface that inputs a video signal and an audio signal from an external device such as a DVD player, a bluray disc player, or a Web streaming receiver (internet modem, etc.). The external signal input portion 2 extracts meta-data input superimposed on the video signal and feeds it to the control circuit 4.

On the other hand, the video decoding circuit 11 decodes a video signal transmitted from the demodulation/separation circuit 3 and transmits the decoded video signal to the video selection/combining circuit 12.

The video selection/combining circuit 12 selects, in accordance with a control command from the control circuit 4, one or more video signals from between a video signal of a broadcast program content input through the video decoding circuit 11 and a video signal of an external input content input through the external signal input portion 2 and transmits the selected signal(s) to the video processing circuit 13.

The video processing circuit 13 generates, in accordance with a control command from the control circuit 4, a frame image signal to be supplied to the liquid crystal driver 14 for displaying a content image on the liquid crystal display panel 15.

The video processing circuit 13 further has a function of regulating the size of an image of each content contained in the frame image signal in accordance with a control signal from the control circuit 4. At that time, the control circuit 4 outputs a size adjustment command of an image of each content to the video processing circuit 13 in accordance with an image size adjusting operation (e.g., an operation of depressing an enlargement key or a reduction key) on the remote control 7.

The liquid crystal driver 14 is a circuit that controls the liquid crystal display panel 15 based on the frame image signal transmitted in sequence at a predetermined cycle from the video processing circuit 13, to allow the liquid crystal display panel 15 to sequentially display images of one frame corresponding to the frame image signal.

The liquid crystal display panel 15 has liquid crystal elements arranged in a matrix fashion and displays a video corresponding to the frame image signal depending on the control provided by the liquid crystal driver 14.

The backlight device 17 is an LED backlight device that illuminates the liquid crystal display panel 15 by a plurality of LEDs and turning on and off of each of the LEDs disposed on the backlight device 17 are controlled by the LED driver 18 and the dimming circuit 19.

The dimming circuit 19 generates a PWM signal with a duty ratio corresponding to a control instruction from the control circuit 4 and feeds the PWM signal to the LED driver 18. The duty ratio is a proportion (on period/(on period+off period))of on period in one cycle of the PWM signal.

The LED driver 18 switches on/off of each of the LEDs of the backlight device 17 in accordance with a PWM signal input from the dimming circuit 19. This allows the luminance of each of the LEDs to be regulated by the duty ratio. One example of dimming portion is made up of the control circuit 4 and the dimming circuit 19 when controlling each of the LEDs by the duty ratio of the PWM signal input into the LED driver 18.

The liquid crystal television receiver X according to the embodiment of the present invention configured in this manner has a feature that the energy loss can be suppressed in the drive of the backlight device 17 and the following is a description thereof.

Figure 2:
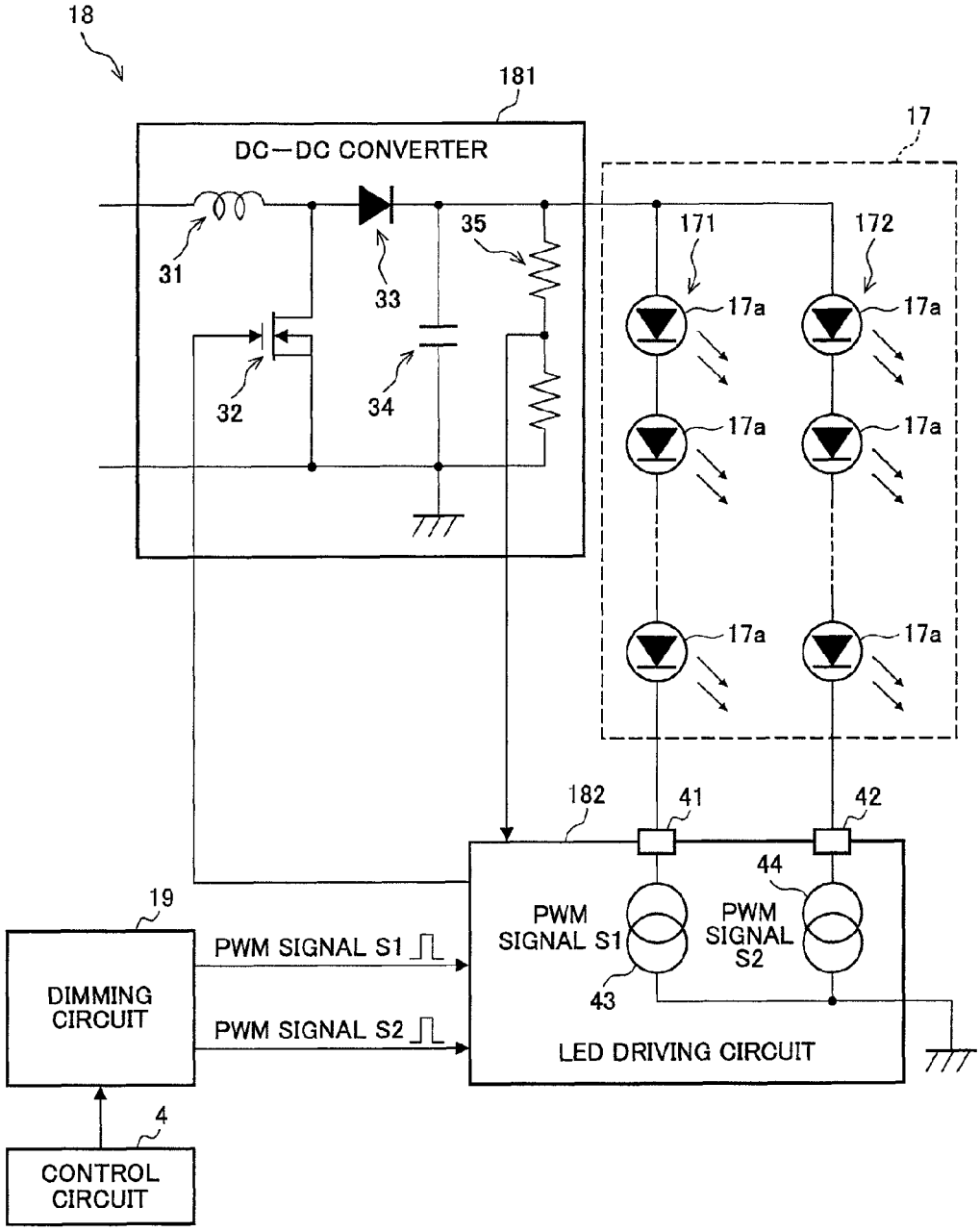
FIG. 2 is a block diagram depicting a schematic configuration of an LED driver 18 mounted on the liquid crystal television receiver X according to the embodiment of the present invention.

FIG. 2 is a main part block diagram for explaining a schematic configuration of the LED driver 18.

As depicted in FIG. 2, the backlight device 17 has a plurality of LEDs 17*a* arranged on the back surface of the liquid crystal display panel 15 and is a so-called direct-under-type LED backlight device that illuminates the liquid crystal display panel 15 from behind by the LEDs 17*a*. The backlight device 17 may be a so-called edge-type backlight that illuminates the liquid crystal display panel 15 from behind by light directed through a light guiding plate from the plurality of LEDs 17*a* arranged on upper and lower and left and right edges of the liquid crystal display panel 15.

The plurality of LEDs 17*a* of the backlight device 17 are divided into two LED groups 171 and 172, with the LEDs making up each of the LED groups 171 and 172 being connected in series. For example, the LED group 171 includes a plurality of LEDs 17*a* arrayed on an odd-numbered line in the vertical direction of the backlight device 17, while the LED group 172 includes a plurality of LEDs 17*a* arrayed on an even-numbered line in the vertical direction of the backlight device 17. Anode terminals of the LEDs 17*a* of the LED groups 171 and 172 are connected in parallel to an output of a DC-DC converter 181 described later disposed on the LED driver 18. On the other hand, cathode terminals of the LEDs 17*a* of the LED groups 171 and 172 are connected to an LED driving circuit 182 described later disposed on the LED driver 18.

The LED driver 18 is a driver IC configured including a single the DC-DC converter 181 that applies a DC voltage to each of the LED groups 171 and 172 of the backlight device 17 and the LED driving circuit 182 that individually controls turn-on and turn-off of each of the LED groups 171 and 172.

The DC-DC converter 181 includes a coil 31, a transistor 32, a diode 33, a capacitor 34, and a voltage dividing circuit 35 and is a power-supply device that boosts and outputs an input DC voltage. In the DC-DC converter 181, application of an input DC voltage to the coil 31 is controlled by the transistor 32 and the DC voltage and an output from the coil 31 are rectified and smoothed through the diode 33 and the capacitor 34 to be output as a boosted DC voltage to the backlight device 17. At this time, the output voltage from the DC-DC converter 181 is regulated by the LED driving circuit 182 controlling the duty ratio of the switching action of the transistor 32. The DC-DC converter 181 is not limited to such a non-isolated boosting circuit and may be another type of DC-DC converter.

The voltage dividing circuit 35 is used to detect an output voltage of the DC-DC converter 181 and the voltage divided by a voltage dividing resistor of the voltage dividing circuit 35 is input to the LED driving circuit 182.

The LED driving circuit 182 includes two control ports 41 and 42 to which the LED groups 171 and 172 are connected and two constant-current output circuits 43 and 44 that output a constant current to the LED groups 171 and 172, respectively. The constant-current output circuits 43 and 44 are each, e.g., a conventionally well-known constant current output circuit using a transistor current mirror, etc.

The LED driving circuit 182 executes a switching action of switching whether to supply a constant current to the LED group 171 by the constant-current output circuit 43 in response to a PWM signal S1 corresponding to the LED group 171 input from the dimming circuit 19. Similarly, the LED driving circuit 182 executes a switching action of switching between supplying and not supplying a constant current to the LED group 172 by the constant-current output circuit 44 in response to a PWM signal S2 corresponding to the LED group 172 input from the dimming circuit 19. This allows the plurality of LEDs 17*a* disposed on the backlight device 17 to turn on and off at the luminance corresponding to the PWM signal for each of the LED groups 171 and 172 connected to the constant-current output circuits 43 and 44. Each of the switching actions of the LED driving circuit 182 is implemented by, e.g., a conventionally well-known switching circuit using a transistor, an FET, etc.

The LED driving circuit 182 has a constant-current control function of executing a constant-current control (that corresponds to a first voltage control mode) for changing the duty ratio of the switching action of the transistor 32 of the DC-DC converter 181 so that a previously set first predetermined voltage is reached by a voltage (hereinafter, referred to as "cathode voltage") applied to the cathode ends of the LEDs 17*a* of the LED groups 171 and 172 connected in parallel. The constant-current control enables an electric power required for driving the LED groups 171 and 172 to be supplied from the DC-DC converter 181 to the backlight device 17. It is thus possible through proper setting of the first predetermined voltage to achieve a stable drive of the LED groups 171 and 172 while preventing an unrequired power supply from the DC-DC converter 181.

The LED driving circuit 182 further has a constant-voltage control function of executing a constant-voltage control (that corresponds to a second voltage control mode) for changing the duty ratio of the switching action of the transistor 32 of the DC-DC converter 181 so that a previously set second predetermined voltage is reached by a voltage (hereinafter, referred to as "anode voltage") applied to the anode ends of the LED groups 171 and 172 from the DC-DC converter 181 in accordance with a voltage input from the voltage dividing circuit 35. The second voltage value is a value sufficiently higher than a minimum voltage LED_Vf required to turn on the LED groups 171 and 172. This enables the LED groups 171 and 172 to be securely turned on when the LED groups 171 and 172 start to be turned on under the constant-voltage control.

The constant-voltage control function and the constant-current control function possessed by the LED driving circuit 182 are implemented by, e.g., a conventionally well-known feedback circuit using a comparator that receives the first predetermined voltage and the second predetermined voltage as reference voltages.

The LED driving circuit 182 switches the control between the constant-voltage control and the constant-current control based on the PWM signals S1 and S2 input from the dimming circuit 19, to control electric power supplied from the DC-DC converter 181.

Specifically, the LED driving circuit 182 executes the constant-current control when at least one of the PWM signals Si and S2 corresponding to the LED groups 171 and 172 input from the dimming circuit 19 goes ON (turn-on state), while it executes the constant-voltage control when all of them go OFF (turn-off state). The LED driving circuit 182 when executing such a control corresponds to a power-supply control portion. Such a configuration may be implemented by a logic circuit or by a control process executed by the MPU.

The dimming circuit 19 individually feeds the PWM signals S1 and S2 to the constant-current output circuits 43 and 44, respectively, of the LED driving circuit 182. Specifically, the dimming circuit 19 generates PWM signals S1 and S2 with a given duty ratio corresponding to control signals on the luminance of the backlight device 17 input from the control circuit 4 and feeds the PWM signals S1 and S2 to the constant-current output circuits 43 and 44, respectively, of the LED driving circuit 182. At this time, the PWM signals S1 and S2 input to the constant-current output circuits 43 and 44 have the same duty ratio.

It is to be noted in the liquid crystal television receiver X according to the embodiment of the present invention that 180-degree phase difference is set to the PWM signals S1 and S2 corresponding respectively to the LED groups 171 and 172 input from the dimming circuit 19 into the LED driving circuit 182. Specifically, the dimming circuit 19 generates two PWM signals S1 and S2 having a phase difference of 180 degrees as the PWM signals S1 and S2 corresponding to the LED groups 171 and 172, respectively, and individually feeds the PWM signals S1 and S2 to the constant-current output circuits 43 and 44 of the LED driving circuit 182. The dimming circuit 19 producing a phase difference to the PWM signals is one example of a phase difference control portion.

Although in this embodiment the phase difference is 180 degrees for explaining the configuration having the two LED groups 171 and 172, a phase difference of $2\pi/n$ is provided if the number of the LED groups connected in parallel to the DC-DC converter 181 is n (n: an integer of 2 or more). For example, if the number of the LED groups is 4, a 90-degree phase difference is set to the PWM signals corresponding respectively to the LED groups.

Figure 3:
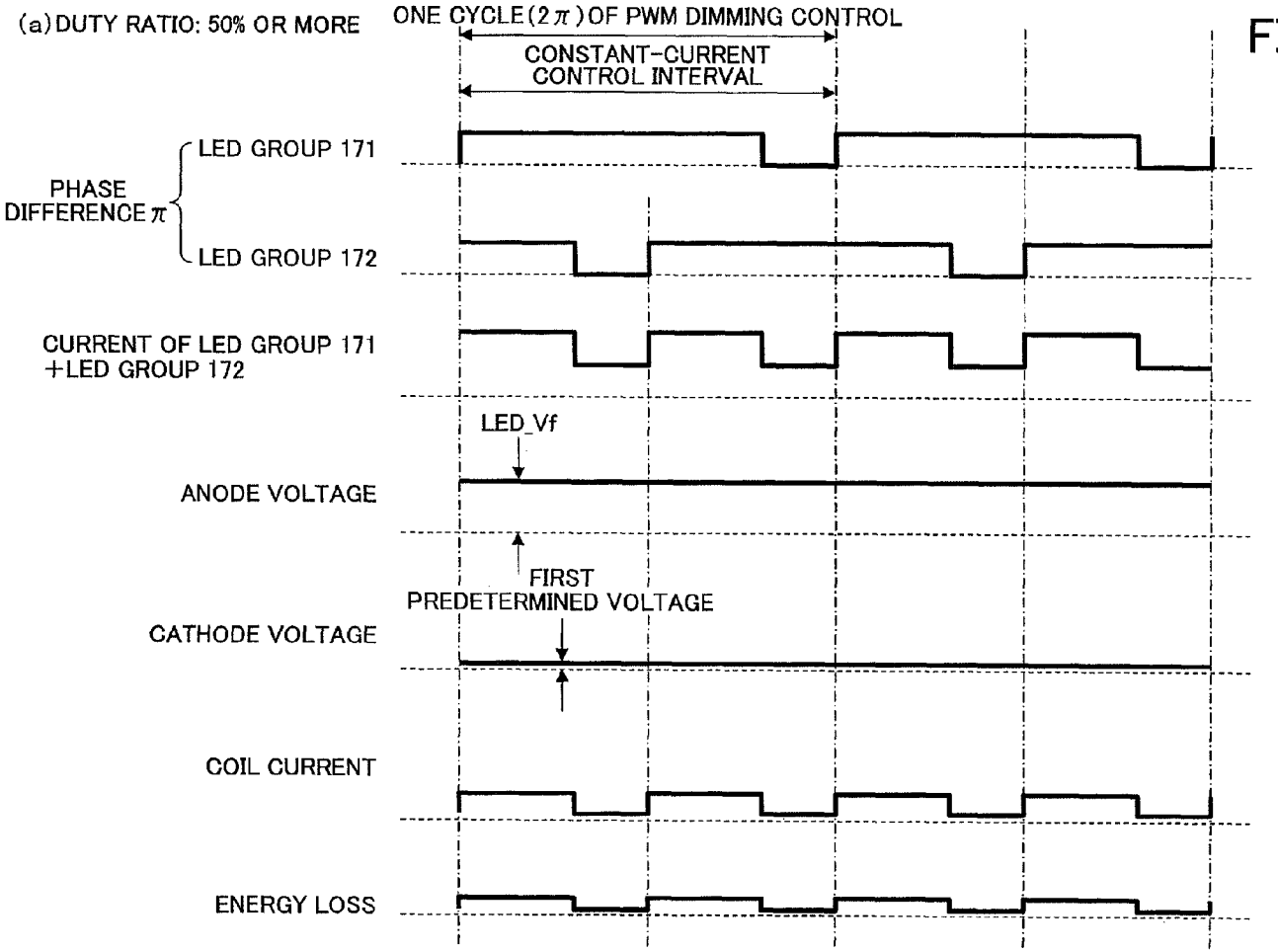
FIG. 3 is a timing chart when there is a phase difference between PWM signals to LED groups 171 and 172.
Figure 4:
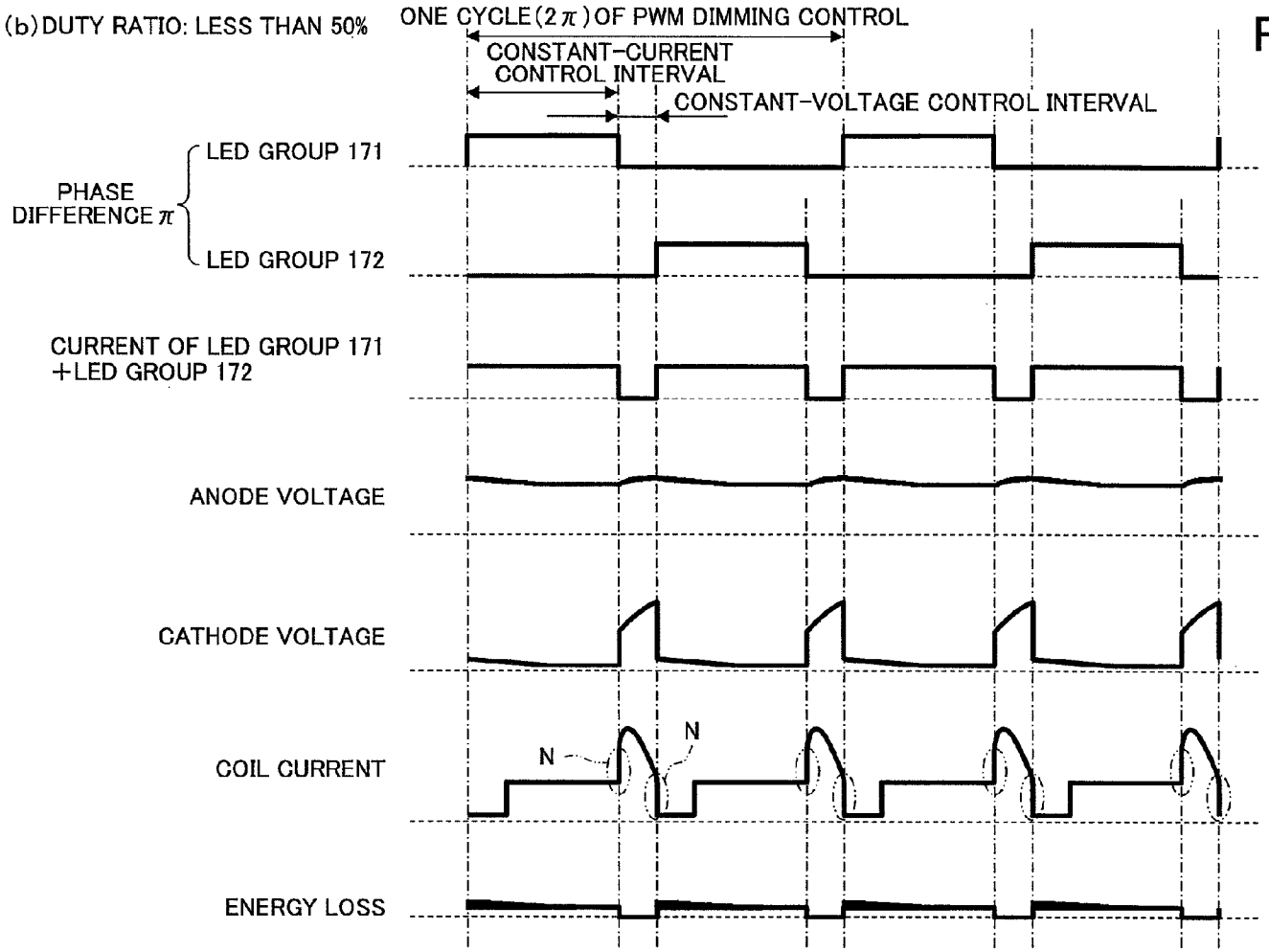
FIG. 4 is a timing chart when there is a phase difference between PWM signals to the LED groups 171 and 172.
Figure 5:
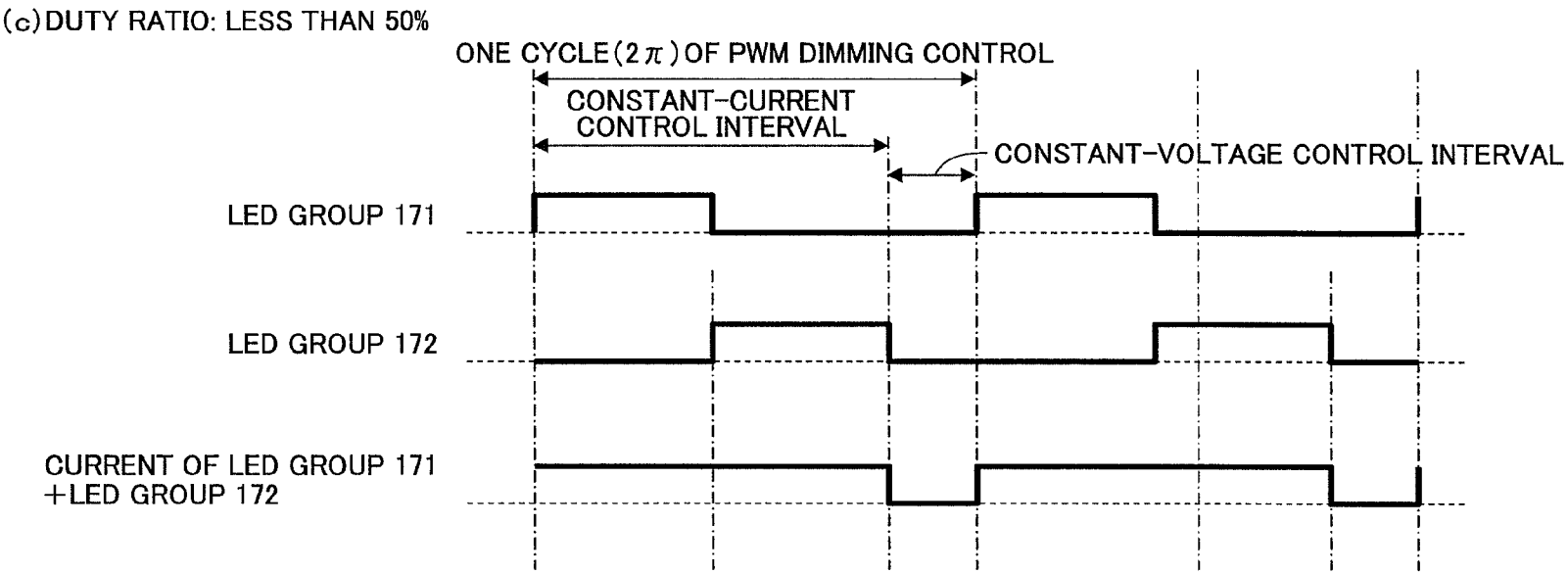
FIG. 5 is a timing chart when there is a phase difference between PWM signals to the LED groups 171 and 172.

FIGS. 3 to 5 are timing charts in the case where a 180-degree phase difference is produced to the PWM signals S1 and S2 corresponding respectively to the LED groups 171 and 172. FIG. 3(*a*) depicts a case of the duty ratio of 80% that is an example of the duty ratio of the PWM signals S1 and S2 not less than 50%, and FIG. 4(*b*) depicts a case of the duty ratio of 40% that is an example of the duty ratio of the PWM signals S1 and S2 less than 50%.

As depicted in FIG. 3(*a*), when the PWM signals S1 and S2 corresponding respectively to the LED groups 171 and 172 have the duty ratio of 80% with a 180-degree phase difference, at least one of the LED groups 171 and 172 is on so that all the LED groups 171 and 172 do not go out at the same time. This applies as long as the PWM signals have the duty ratio of 50% or more.

Figure 6:
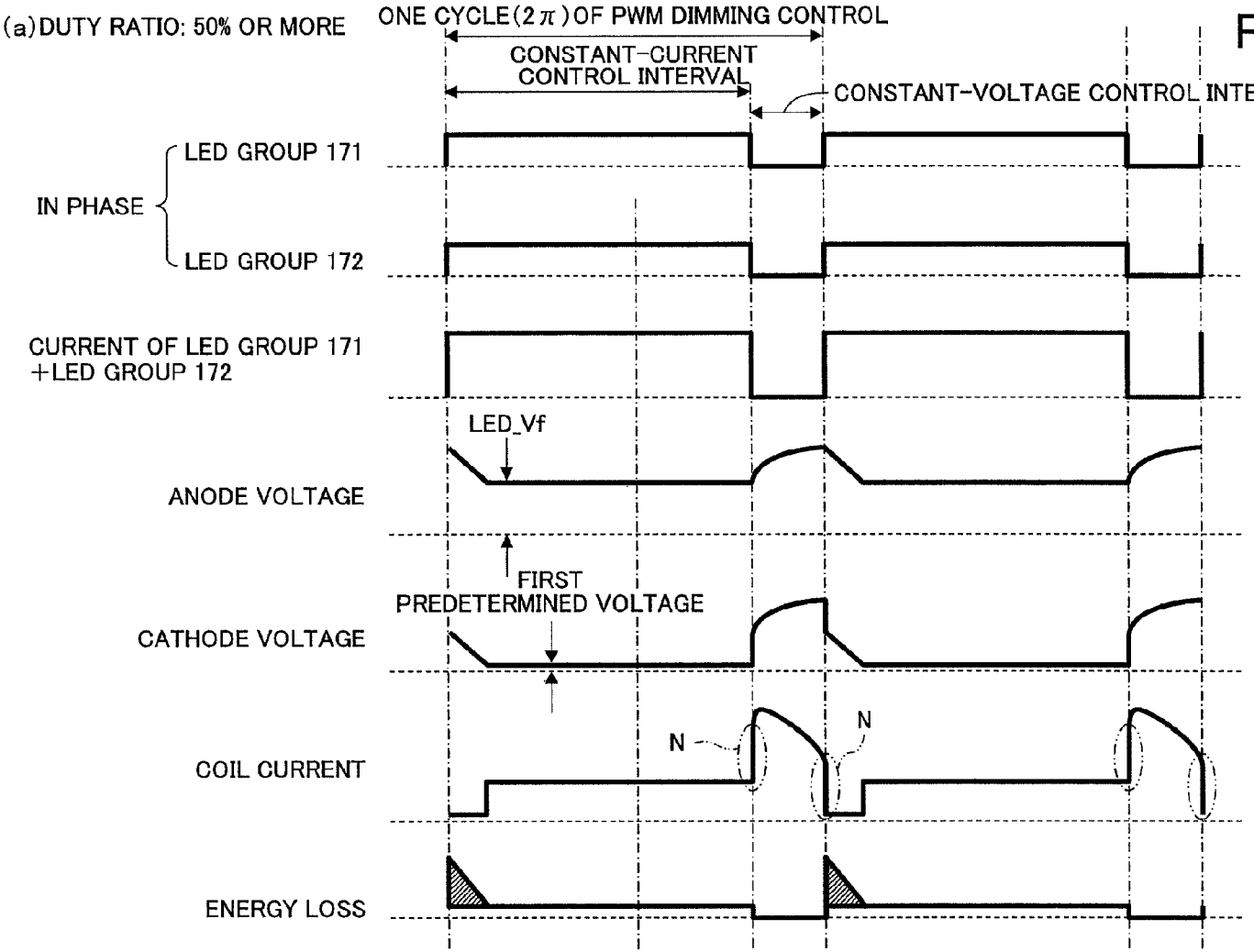
FIG. 6 is a timing chart when there is no phase difference between PWM signals to the LED groups 171 and 172.

Thus, the LED driving circuit 182 controls electric power supplied from the DC-DC converter 181 by the constant-current control at all times so that no switching is performed between the constant-current control and the constant-voltage control (see FIG. 6(*a*)). As a result, the energy loss and noise can be prevented at the time of switching between the constant-current control and the constant-voltage control.

As depicted in FIG. 4(*b*), on the other hand, when the PWM signals S1 and S2 corresponding respectively to the LED groups 171 and 172 have the duty ratio of 40% with a 180-degree phase difference, there is a timing at which all the LED groups 171 and 172 go off at the same time. This applies as long as the PWM signals have the duty ratio less than 50%.

Accordingly, the LED driving circuit 182 performs a switching between the constant-current control and the constant-voltage control to control the electric power supplied from the DC-DC converter 181. Note that occurrence of the 180-degree phase difference to the PWM signals reduces the period of time during which all the LED groups 171 and 172 are off as compared with a case where the PWM signals are in phase (see FIG. 7(*b*)). The output voltage of the DC-DC converter 181 is gradually increased through a predetermined response period after the duty change in the switching action of the transistor 33.

For this reason, the switching from the constant-voltage control to the constant-current control is performed in a state where the anode voltage applied from the DC-DC converter 181 to the LED groups 171 and 172 is not yet sufficiently boosted and is relatively low. This enables the energy loss expressed by the cathode voltage×LED current to be suppressed as compared with the case where the PWM signals are in phase (see FIG. 7(*b*)).

Although this embodiment is configured by way of example such that the dimming circuit 19 generates two PWM signals S1 and S2 having a phase difference of 180 degrees and feeds the PWM signals S1 and S2 to the LED driving circuit 182, this is not limitative.

It is also conceivable, for example, that the dimming circuit 19 outputs two PWM signals S1 and S2 in phase, one of which is delayed by a delay circuit disposed between the constant-current output circuits 43 and 44 of the LED driving circuit 182 so that a 180-degree phase difference is provided between the PWM signals S1 and S2 fed to the constant-current output circuits 43 and 44. In this case, the delay circuit corresponds to a phase difference control portion.

EXAMPLE 1

In the above embodiment, the case has been described by way of example where a phase difference of 180 degrees ($2\pi/n$) is produced to the PWM signals S1 and S2 irrespective of the duty ratio of the PWM signals S1 and S2.

On the contrary, when the duty ratio of the PWM signals S1 and S2 is less than 50% (100/n), the turn-on timings of the LED groups 171 and 172 do not overlap if the phase difference between the PWM signals S1 and S2 is not more than 180 degrees ($2\pi/n$) and is more than 3.6 times (converted value of the duty ratio into the phase) the value of that duty ratio.

It is thus conceivable to give a control instruction to the dimming circuit 19 such that, if the set value of the duty ratio is not less than a first predetermined value that is not less than 100/n %, a phase difference of $2\pi/n$ is produced to the PWM signals corresponding to the plurality of LED groups and such that, if the set value of the duty ratio is less than a second predetermined value that is not more than 100/n %, the PWM signals corresponding to the LED groups have a previously defined phase difference that is more than 3.6 times the value of the duty ratio and is not more than $2\pi/n$.

As a result, when the duty ratio is less than 100/n, the phase difference is provided so that the turn-on timings of the LED groups 171 and 172 do not overlap. For example, when the PWM signals of the two LED groups 171 and 172 have a duty ratio of 40% similar to FIG. 4(*b*), the dimming circuit 19 sets to the PWM signals S1 and S2 a phase difference that is more than 3.6 times the value of that duty ratio and is not more than $2\pi/n$ as depicted in FIG. 5(*c*), with the result that the turn-on timings of the LED groups 171 and 172 do not overlap. Thus, as compared with a case where the PWM signals are in phase (see FIG. 7(*b*)), the period is shortened during which all the LED groups 171 and 172 are off, i.e., during which constant-voltage control is executed, to consequently achieve a suppression of the energy loss expressed by the cathode voltage× LED current.

Also when the duty ratio is 50% or more, at least one of the LED groups 171 and 172 goes on by setting to the PWM signals S1 and S2 a predetermined phase difference that is not less than $2\pi/n$ and is not more than 3.6 times the value of that duty ratio, as a result of which no switching is performed between the constant-current control and the constant-voltage control so that the energy loss and noise can be suppressed. It is desirable since an excessive phase difference exceeding $2\pi/n$ brings about a lowering of the accuracy of the dimming control that the phase difference be fixed at 180 degrees ($2\pi/n$) that is set to the PWM signals S1 and S2 when the duty ratio is 50% or more as described earlier.

EXAMPLE 2

In the above embodiment, the configuration was described which suppressed the energy loss by setting a 180-degree phase difference to the PWM signals S1 and S2 corresponding to the LED groups 171 and 172, respectively.

Figure 7:
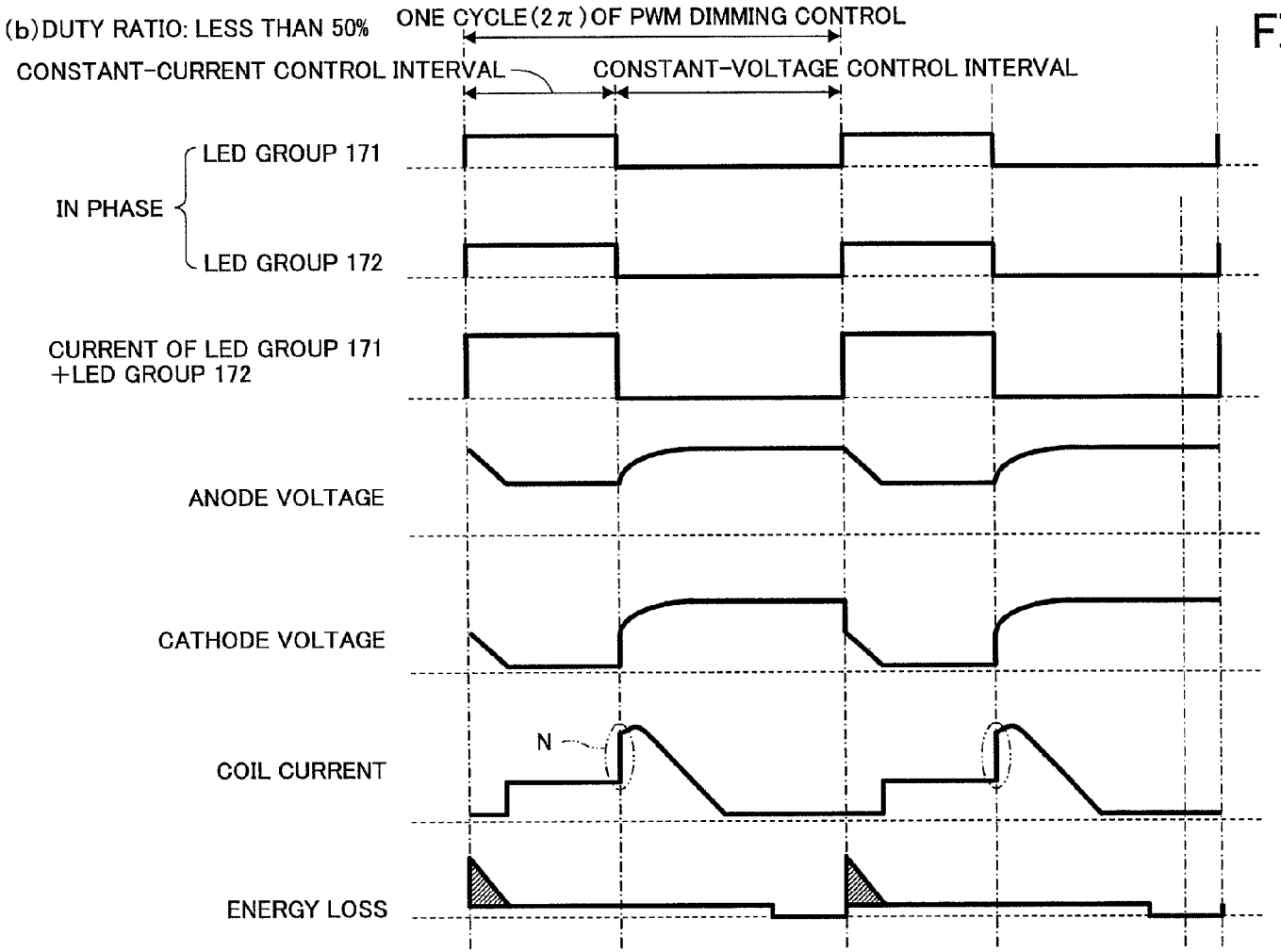
FIG. 7 is a timing chart when there is no phase difference between PWM signals to the LED groups 171 and 172.

When the PWM signals S1 and S2 have the duty ratio of less than 50% during lighting period, if a 180-degree phase difference is occurring between the PWM signals S1 and S2 of the respective LED groups 171 and 172, the number of times of switching between the constant-current control and the constant-voltage control increases as depicted in FIG. 4(*b*) as compared with the case where the PWM signals S1 and S2 are in phase (see FIG. 7(*b*)), with the result that the number of times of occurrence of noise N upon the switching also increases.

It is thus conceivable when a quiet performance is required as a performance of the liquid crystal television receiver X that the control circuit 4 is configured to switch the phase difference of the PWM signals S1 and S2 between 180 degrees and 0 degrees (in phase) depending on the duty ratio of the PWM signals S1 and S2 of the LED groups 171 and 172, respectively. This will hereinafter be described in detail.

More specifically, the control circuit 4 is set depending on the luminance required for the backlight device 17 and gives a control instruction to the dimming circuit 19 so that, if the duty ratio of PWM signals S1 and S2 corresponding to the LED groups 171 and 172 generated by the dimming circuit 19 is 50% (one example of the first predetermined value) or more, the PWM signals S1 and S2 have a phase difference of 180 degrees and so that, if it is less than 50% (one example of the second predetermined value), the PWM signals S1 and S2 are in phase. This allows the dimming circuit 19 to produce a 180-degree phase difference to the PWM signals S1 and S2 if the duty ratio is 50% or more and to put the PWM signals S1 and S2 in phase if it is less than 50%.

A conventionally well-known technique may be used for a configuration of the dimming circuit 19 for changing whether to produce a phase difference to the PWM signals S1 and S2. For example, in a configuration using a shift register, it may be implemented by changing a pulse signal input to the shift register. In a configuration using a logic counter, the count timing may be changed. Naturally, two PWM signal generation circuit may be provided so as to switch the PWM signal generation circuit on a hardware basis.

According to the configuration of this example, if the duty ratio of the PWM signals S1 and S2 is 50% or more, the PWM signals S1 and S2 are allowed to have a phase difference of 180 degrees (see FIG. 3(*a*)) so that the energy loss and noise can both be suppressed as set forth in the embodiment.

On the contrary, if the duty ratio of the PWM signals S1 and S2 is less than 50%, the PWM signals S1 and S2 are allowed to be in phase (see FIG. 7(*b*)), to consequently elongate the section through which the PWM signals S1 and S2 are off at the same time, i.e., the period during which the constant-voltage control is carried out, so that a gentle current change is ensured upon switching from the constant-current control to the constant-voltage control, thereby achieving a suppression of occurrence of the noise N upon the switching.

The index value of the duty ratio is not limited to 50% (one example of the first predetermined value and the second predetermined value) for switching the phase difference of the PWM signals S1 and S2 between 180 degrees and 0 degrees. For example, the phase difference switching index (the first predetermined value and the second predetermined value) may be set with hysteresis.

Specifically, the phase difference is initially set depending on whether the duty ratio is 50% or more and, thereafter, switching may be made from the absence of a phase difference to the presence of a phase difference on the condition that the duty ratio is 60% (one example of the first predetermined value) or more that is not less than 50%, whereas switching may be made from the presence of a phase difference to the absence of a phase difference on the condition that the duty ratio is less than 40% (one example of the second predetermined value) that is not more than 50%. This prevents hunting that the phase difference switching is executed frequently and can reduce the processing load of the control circuit 4.

The configuration may be such that switching can be made between the configuration described in the embodiment and the configuration described in this example. Specifically, in response to the initial setting or the user settings by the remote control operation, the control circuit 4 may perform a switching between a fixed phase difference mode in which the phase difference of the PWM signals S1 and S2 is fixed at $2\pi/n$ (n: the number of LED groups) and a changeable phase difference mode in which the phase difference of the PWM signals is switched between $2\pi/n$ and 0 degrees (in phase) depending on the duty ratio of the PWM signals S1 and S2.

For example, the control circuit 4 may execute the fixed phase difference mode to achieve power saving when the liquid crystal television receiver X operates in a power saving mode, whereas the control circuit 4 may allow an operation in the changeable phase difference mode to achieve noise suppression when the receiver X operates in an ordinary operation mode.

EXPLANATIONS OF LETTERS OR NUMERALS

X . . . liquid crystal television receiver (one example of liquid crystal display apparatus), 1 . . . tuner, 2 . . . external signal input portion, 3 . . . demodulation/separation circuit, 4 . . . control circuit, 6 . . . remote control light receiving portion, 7 . . . remote control, 11 . . . video decoding circuit, 12 . . . video selection/combining circuit, 13 . . . video processing circuit, 14 . . . liquid crystal driver, 15 . . . liquid crystal display panel, 17 . . . backlight device, 17*a* . . . LED, 171, 172 . . . LED group, 18 . . . LED driver, 181 . . . DC-DC converter, 182 . . . LED driving circuit, 19 . . . dimming circuit, 21 . . . audio decoding circuit, 22 . . . audio selection circuit, 23 . . . audio processing circuit, 24 . . . amplifier, 25 . . . speaker, 31 . . . coil, 32 . . . transistor, 33 . . . diode, 34 . . . capacitor, 35 . . . voltage dividing circuit, 41, 42 . . . control port, 43, 44 . . . constant-current output circuit

The invention claimed is:

1. An LED control device turning on and off a plurality of LEDs for each of LED groups connected to a plurality of constant-current output circuits, comprising:

an LED driving portion that individually controls whether to supply currents to the LED groups by the constant-current output circuits, in accordance with PWM signals input corresponding respectively to the LED groups;

a power-supply control portion that, when at least one of the LED groups is turned on, controls a power supplied from a power-supply device to which the LED groups are connected in parallel by a first voltage control mode in which a voltage at a cathode end of the lighting LED group is kept at a predetermined first voltage value, and, when all the LED groups are turned off, controls the power by a second voltage control mode in which a voltage at an anode end of the LED group is kept at a predetermined second voltage value; and a phase difference control portion that produces a phase difference of $2\pi/n$ (n: the number of LED groups) to the PWM signals corresponding respectively to the LED groups input to the LED driving portion, a dimming portion that controls luminance of the LED by a duty ratio of the PWM signal input to the LED driving portion, wherein the phase difference control portion produces a phase difference of $2\pi/n$ to the PWM signals if the duty ratio of a lighting period set by the dimming portion is not less than a first predetermined value that is 100/n % or more and produces a phase difference not less than 3.6 times the value of the duty ratio and not more than $2\pi/n$ to the PWM signals if the duty ratio is less than a second predetermined value that is not more than 100/n %, and the first predetermined value and the second predetermined value are set with hysteresis.

2. The LED control device as defined in claim 1, wherein the plurality of LEDs are equipped on a backlight device that illuminates a liquid crystal display panel.

3. A liquid crystal display apparatus comprising the LED control device as defined in claim 1.

* * * * *